US009458408B2

(12) United States Patent
Smith

(10) Patent No.: US 9,458,408 B2
(45) Date of Patent: Oct. 4, 2016

(54) THERMALLY STABLE SUBSEA CONTROL HYDRAULIC FLUID COMPOSITIONS

(71) Applicant: MacDermid Offshore Solutions, LLC, Waterbury, CT (US)

(72) Inventor: Ian D. Smith, Adlington (GB)

( * ) Notice: Subject to any disclaimer, the term of this patent is extended or adjusted under 35 U.S.C. 154(b) by 263 days.

(21) Appl. No.: 14/157,928

(22) Filed: Jan. 17, 2014

(65) Prior Publication Data

US 2014/0135240 A1 May 15, 2014

Related U.S. Application Data

(63) Continuation of application No. 12/469,337, filed on May 20, 2009, now Pat. No. 8,633,141, which is a continuation-in-part of application No. 12/173,284, filed on Jul. 15, 2008, now Pat. No. 8,759,265.

(51) Int. Cl.

| | |
|---|---|
| ***C10M 173/02*** | (2006.01) |
| ***C10M 129/42*** | (2006.01) |
| ***C10M 133/38*** | (2006.01) |
| ***C10M 173/00*** | (2006.01) |

(52) U.S. Cl.

CPC ..... *C10M 173/02* (2013.01); *C10M 173/00* (2013.01); *C10M 2201/062* (2013.01); *C10M 2201/087* (2013.01); *C10M 2207/02* (2013.01); *C10M 2207/022* (2013.01); *C10M 2207/08* (2013.01); *C10M 2207/10* (2013.01); *C10M 2207/123* (2013.01); *C10M 2207/126* (2013.01); *C10M 2207/127* (2013.01); *C10M 2207/142* (2013.01); *C10M 2207/16* (2013.01); *C10M 2209/10* (2013.01); *C10M 2209/103* (2013.01); *C10M 2209/104* (2013.01); *C10M 2209/105* (2013.01); *C10M 2215/04* (2013.01); *C10M 2215/14* (2013.01); *C10M 2215/22* (2013.01); *C10M 2215/221* (2013.01); *C10M 2215/222* (2013.01); *C10M 2215/223* (2013.01); *C10M 2215/225* (2013.01); *C10M 2215/226* (2013.01); *C10M 2219/044* (2013.01); *C10M 2223/04* (2013.01); *C10M 2223/041* (2013.01); *C10M 2223/049* (2013.01); *C10M 2223/10* (2013.01); *C10N 2230/08* (2013.01); *C10N 2230/10* (2013.01); *C10N 2230/40* (2013.01); *C10N 2230/66* (2013.01); *C10N 2240/08* (2013.01)

(58) Field of Classification Search

CPC ..... C10M 173/00; C10M 173/02; C10M 2201/06; C10M 2201/087; C10M 2207/02; C10M 2207/022; C10M 2207/08; C10M 2207/10; C10M 2207/123; C10M 2207/126; C10M 2207/127; C10M 2207/142; C10M 2207/16; C10M 2209/10; C10M 2209/103; C10M 2209/104; C10M 2209/105; C10M 2215/04; C10M 2215/14; C10M 2215/22; C10M 2215/221; C10M 2215/222; C10M 2215/223; C10M 2215/225; C10M 2215/226; C10M 2219/044; C10M 2223/04; C10M 2223/041; C10M 2223/049; C10M 2223/10; C10N 2240/08; C10N 2230/10; C10N 2230/40; C10N 2230/08

USPC ..... 508/200, 110, 170, 469

See application file for complete search history.

(56) References Cited

U.S. PATENT DOCUMENTS

| | | | | |
|---|---|---|---|---|
| 3,994,948 A * | 11/1976 | Jayne | C10M 3/00 | 252/78.3 |
| 4,138,346 A * | 2/1979 | Nassry | C10M 173/02 | 252/389.21 |
| 5,178,786 A * | 1/1993 | Jahnke | C10M 141/06 | 252/392 |
| 2007/0078068 A1* | 4/2007 | Askew | C09K 8/34 | 508/428 |
| 2009/0036331 A1* | 2/2009 | Smith | C09K 8/04 | 507/138 |

* cited by examiner

*Primary Examiner* — James Goloboy
(74) *Attorney, Agent, or Firm* — Carmody Torrance Sandak & Hennessey LLP

(57) ABSTRACT

An aqueous hydraulic fluid composition comprising of one or more lubricants such as a monovalent metal salt, ammonium, or amine salt of a dicarboxylic acid, such as a C21 dicarboxylic acid is described in which the aqueous hydraulic fluid composition demonstrates increased thermal stability when exposed to elevated temperatures for a prolonged period of time while being able to tolerate the presence of 10% v/v synthetic seawater. The aqueous hydraulic fluid composition contains less than about 20% by weight (preferably none or substantially none) of an oil selected from the group consisting of mineral oils, synthetic hydrocarbon oils, and mixtures thereof. The hydraulic fluid hereof preferably comprises a cyclical or ring base tertiary amine with no hydroxyl functionality such as 1,4-dimethyl piperazine.

23 Claims, No Drawings

THERMALLY STABLE SUBSEA CONTROL HYDRAULIC FLUID COMPOSITIONS

CROSS REFERENCE TO RELATED APPLICATIONS

This is a continuation-in-part application of application Ser. No. 12/173,284, filed Jul. 15, 2008, the subject matter of which is herein incorporated by reference in its entirety.

FIELD OF THE INVENTION

This invention relates to aqueous hydraulic fluid compositions, especially hydraulic fluid compositions having improved thermal stability.

BACKGROUND OF THE INVENTION

Hydraulic fluids are low viscosity fluids used for the transmission of useful power by the flow of the fluid under pressure from a power source to a load. A liquid hydraulic fluid generally transmits power by virtue of its displacement under a state of stress. Hydraulic fluids generally operate with a low coefficient of friction. To be effective, the compositions typically have sufficient antiwear, antiweld, and extreme pressure properties to minimize metal damage from metal-to-metal contact under high load conditions.

Hydraulic fluids are usable in subsea control devices that are used to control well-head pressure of an oil well under production. The hydraulic equipment can open or close a well, choke the oil or gas flow, inject chemicals into the well or divert water and/or gas into the well to re-pressurise the system. Some of the hydraulic components are placed within the well, such as the Down Hole Safety Valve and 'Smart Well' flow control systems.

One of the biggest challenges in the oil and gas industry is to 'produce' oil and gas from harsher environments with high pressure and temperature. Since part of the hydraulic system is within the well, the hydraulic equipment and the associated fluid must also be suitable to survive these temperatures and maintain performance. In addition, the demand for aqueous based hydraulic fluid compositions such as may be used in subsea devices continues to increase due to the environmental, economic and safety (e.g. non-flammability) advantages of such fluids over conventional non-aqueous, oil-type hydraulic fluids.

Many conventional hydraulic fluids are not suitable for marine and deep sea applications due to their low tolerance to sea water contamination or to contamination by hydrocarbons, i.e., they tend to readily form emulsions with small amounts of seawater. Furthermore, in marine environments, problems arise due to the lack of biodegradability of the hydraulic fluid and to bacterial infestations arising in the hydraulic fluid, especially from anaerobic bacteria such as the sulphate reducing bacteria prevalent in sea water.

Other problems associated with the use of conventional hydraulic fluids under the extreme conditions encountered in marine and deep sea devices include: (1) some conventional hydraulic fluids may cause corrosion of metals in contact with the fluid; (2) some conventional hydraulic fluids are reactive with paints or other metal coatings or tend to react with elastomeric substances or at least cause swelling of elastomeric substances; (3) poor long-term stability, especially at elevated temperatures; (4) some hydraulic fluids require anti-oxidants to avoid the oxidation of contained components; (5) some hydraulic fluids are not readily concentrated for ease in shipping; and (6) many conventional hydraulic fluids have a non-neutral pH, thereby enhancing the opportunity for reaction with materials in contact with it. For all of these reasons, it has become advantageous to use aqueous hydraulic fluids in certain marine and deep sea applications and various aqueous formulations have been developed that are usable in such applications.

The OSPAR Convention for the Protection of the Marine Environment of the North-East Atlantic provides a framework for environmental requirements of chemicals used offshore. There are currently few if any water based fluids that can maintain lubrication at high temperature and meet the required environmental profile.

The inventor of the present invention has identified other lubricants that provide good lubricity and good stability for use under the extreme conditions encountered in subsea devices. In particular the inventor of the present invention has determined that salts of a diacid can be used with good results to improve lubricity of an aqueous hydraulic fluid composition. In addition, the inventor has discovered that 1,4-dimethyl piperazine can be effectively used to buffer hydraulic fluids.

SUMMARY OF THE INVENTION

It is an object of the present invention to provide an improved aqueous hydraulic fluid composition for use under the extreme thermal conditions encountered in subsea control devices.

It is another object of the present invention to provide an aqueous hydraulic fluid composition that retains its lubricity after exposure to high temperatures and pressure.

It is still another object of the present invention to provide an aqueous hydraulic fluid concentrate that has good stability, even in the presence of 10% v/v synthetic seawater and can prevent or minimize the formation of problematic "hydrates".

It is still another object of the present invention to provide an aqueous hydraulic fluid composition that has greater thermal stability for a long period of time.

It is still another object of the present invention to provide a hydraulic fluid composition that contains materials that are environmentally acceptable substances.

To that end, the present invention relates to an improved aqueous hydraulic fluid composition comprising:

(i) a lubricant comprising (a) an amine, ammonium, or monovalent metal salt of one or more dicarboxylic acids or (b) a dicarboxylic acid; and (ii) preferably, 1,4-dimethyl piperazine;

wherein the hydraulic fluid composition is substantially free of an oil selected from the group consisting of mineral oils, synthetic hydrocarbon oils, and mixtures thereof.

DETAILED DESCRIPTION OF THE PREFERRED EMBODIMENTS

The present invention is directed to an aqueous hydraulic fluid composition, for example, for use under the extreme conditions encountered in subsea control devices.

Accordingly, the present invention relates generally to an aqueous hydraulic fluid composition comprising:

(i) a lubricant comprising (a) an amine, ammonium, or monovalent metal salts of one or more dicarboxylic acids or (b) a dicarboxylic acid;

(ii) preferably, a cyclical or ring based tertiary amine with no hydroxy functionality such as 1,4-dimethyl piperazine.

wherein the hydraulic fluid composition is substantially free of an oil selected from the group consisting of mineral oils, synthetic hydrocarbon oils, and mixtures thereof.

By a diacid or dicarboxylic acid, I mean an organic acid comprising two carboxylic acid groups. Preferred monovalent metal salts include the salts formed from reacting the chosen dicarboxylic acid with alkali metals hydroxides.

In one embodiment, the present invention utilizes an aqueous solution of a salt of a diacid. In one preferred embodiment, the diacid is an alkyl C21 dicarboxylic acid and the salt is a potassium salt or amine salt of the C21 dicarboxylic acid. It is believed that the potassium salt of this diacid is more water soluble than the diacid itself and is therefore preferable. One preferable compound in this regard is 2-cyclohexene-1-octanoic acid, 5-carboxy-4-hexyl and its potassium salt. Generally the dicarboxylic acids (or salts thereof) used in this invention preferably have carbon chain lengths (straight, branched or cyclic) of from 5-30 carbons. Preferably the hydraulic fluid of the invention comprises more than one dicarboxylic acid or salt thereof. The concentration of the dicarboxylic acid salt in the hydraulic fluid of the invention should preferably range from 0.1 to 35% by weight.

In addition, the inventor of the present invention have determined that the lubrication, corrosion and other physical properties of the dicarboxylic acid salt(s) in hydraulic fluid formulations are maintained after exposure to high temperatures such as 190° C. for a considerable length of time (30 days or more). Certain amines and other salts of such dicarboxylic acids in the formulation are also believed to exhibit high thermal and seawater stability.

In addition, the hydraulic fluid composition of the invention may also preferably comprise a second lubricant, said second lubricant selected from the group consisting of alkyl/aryl phosphate esters, alkyl/aryl phosphite esters, phospholipids, mono, di, tri, or polymeric carboxylic acid salts and combinations of the foregoing. Phospholipids usable in the formulations of the invention include any lipid containing a phosphoric acid derivative, such as lecithin or cephalin, preferably lecithin or derivatives thereof. Examples of phospholipids include phosphatidylcholine, phosphatidylserine, phosphatidylinositol, phosphatidylethanolamine, phosphatidic acid and mixtures thereof. The phospholipids may also be glycerophospholipids, more preferably, glycero derivatives of the above listed phospholipids. Typically, such glycerophospholipids have one or two acyl groups on a glycerol residue, and each acyl group contains a carbonyl and an alkyl or alkenyl group. The alkyl or alkenyl groups generally contain from about 8 to about 30 carbon atoms, preferably 8 to about 25, most preferably 12 to about 24. Examples of these groups include octyl, dodecyl, hexadecyl, octadecyl, docosanyl, octenyl, dodecenyl, hexadecenyl and octadecenyl. The concentration of the secondary lubricant in the hydraulic fluid of the invention should preferably range from 0.1 to 20% by weight.

The acyl groups on the glycerophospholipids are generally derived from fatty acids, which are acids having from about 8 to about 30 carbon atoms, preferably about 12 to about 24, most preferably about 12 to about 18 carbon atoms. Examples of fatty acids include myristic, palmitic, stearic, oleic, linoleic, linolenic, arachidic, arachidonic acids, or mixtures thereof, preferably stearic, oleic, linoleic, and linolenic acids or mixtures thereof.

Derivatives of phospholipids, including acylated or hydroxylated phospholipids may also be used in the practice of the invention. For instance, lecithin as well as acylated and hydroxylated lecithin may be used in the present invention as a primary or secondary lubricant.

Phospholipids may be prepared synthetically or derived from natural sources. Synthetic phospholipids may be prepared by methods known to those in the art. Naturally derived phospholipids are extracted by procedures known to those in the art. Phospholipids may be derived from animal or vegetable sources. Animal sources include fish, fish oil, shellfish, bovine brain and any egg, especially chicken eggs. Vegetable sources include rapeseed, sunflower seed, peanut, palm kernel, cucurbit seed, wheat, barley, rice, olive, mango, avocado, palash, papaya, jangli, bodani, carrot, soybean, corn, and cottonseed. Phospholipids may also be derived from micro organisms, including blue-green algae, green algae, bacteria grown on methanol or methane and yeasts grown on alkanes. In a preferred embodiment, the phospholipids are derived from vegetable sources, including soybean, corn, sunflower seed and cottonseed.

The second lubricant may also comprise an alkoxylate salt as a second lubricant for the hydraulic fluid composition. The inventors of the present invention have determined that an improvement in lubricity and seawater stability may be realized by adding an alkoxylate salt (preferably a metal or amine salt of a mono, di, tri or polymeric alkoxylate) to the composition. Suitable alkoxylate salts include salts of alkoxylates with from 2 to 30 carbons in the alkoxylate carbon chain (straight, branched or cyclic). It is also known that typical compositions can be very difficult to stabilize thermally. The inventor of the present invention has surprisingly discovered that the use of alkoxylate salt(s) to the aqueous hydraulic fluid composition stabilizes the fluid composition from thermal degradation, even in the presence of 10% v/v synthetic seawater which gives the fluid compositions a much longer service life under extreme conditions.

The aqueous hydraulic fluid compositions of the invention may also contain a biocide. The biocide is chosen so as to be compatible with the lubricating components, i.e., it does not affect lubricating properties. In one embodiment, a boron containing salt, such as borax decahydrate, is used as the biocide. In another embodiment the biocide may be a sulfur-containing biocide or a nitrogen-containing biocide. Nitrogen-containing biocides include gluteraldehyde, triazines, oxazolidines, and guanidines as well as compounds selected from fatty acid quaternary ammonium salts, such as didecyl dimethyl quaternary ammonium chloride salt. The concentration of the biocide is sufficient to at least substantially prevent bacterial growth in the hydraulic fluid and preferably to kill the bacteria present.

The hydraulic fluid may also comprise an antifreeze additive capable of lowering the freezing point of the hydraulic fluid to at least about −30° F., which is below the minimum temperature expected to be encountered in such environments. If used, the antifreeze additive is chosen so as to be non-reactive with the lubricating components and biocide and is therefore not detrimental to the lubricating properties of the hydraulic fluid. In one embodiment, the anti-freeze additive comprises at least one alcohol (preferably a dihydroxy alcohol) having from 2 to 4 carbon atoms in an amount sufficient to reduce the freezing point to below −30° F. Preferred alcohols include monoethylene glycol, glycerol, propylene glycol, 2-butene-1,4-diol, polyglycol ethers, polyethylene glycols or polypropylene glycols. In one preferred embodiment, monoethylene glycol, which is PLONOR approved is used as the anti-freeze additive of the invention in an amount sufficient to reduce the freezing point of the hydraulic fluid composition to the desired temperature whilst preventing the formation of "hydrates" in the subsea equipment during use.

The hydraulic fluid may also comprise one or more surfactants such as an alcohol ethyoxylate or co-solvents such as polyalkylene glycol or mixtures of both to help with seawater stability (tolerance).

In a preferred embodiment, the hydraulic fluid composition of the invention may also contain one or more corrosion inhibitors that prevent corrosion and oxidation. Examples of corrosion inhibitors include, inorganic/organic phosphates/phosphites, mono, di, tri or polymeric carboxylic acids neutralized with an alkylamine, ammonium or monovalent metal, amine carboxylates, alkylamines and alkanolamines as well as copper corrosion inhibitors such as benzotriazoles. Suitable alkylamines include monoethanolamine and triethanolamine. Suitable alkylamines comprise a $C_4$-$C_{20}$ linear or branched alkyl group or ring structure, preferably with no hydroxyl functionality. Other corrosion inhibitors usable in the practice of the invention include water-soluble polyethoxylated fatty amines and polyethoxylated diamines. The corrosion inhibitor is usable in a concentration sufficient so that substantially no corrosion occurs, i.e., corrosion, if present, results in a loss of less than 10 microns per year in the thickness of a metal in contact with the hydraulic fluid. The concentration of the corrosion inhibitor in the hydraulic fluid of this invention should preferably range from 0.1 to 20% by weight.

In addition to the above noted ingredients, it is important to maintain the pH of the hydraulic fluid between 8 and 10, preferably between 9 and 9.5. Maintenance of the pH of the hydraulic fluid in the prescribed range is important for many reasons, including (i) minimizing corrosion or degradation of metal and/or plastic parts that come into contact with the hydraulic fluid, (ii) ease of handling the hydraulic fluid, and (iii) stability of the components of the hydraulic fluid. Thus it is important to provide a buffer in the hydraulic fluid to assist in maintaining the pH within the preferred range. In this regard the buffer must be stable and effective at the temperatures experienced by the hydraulic fluid which range from about 20° F. to about 420° F. The inventor herein has discovered that cyclical or ring based tertiary amines with no hydroxyl functionality are effective buffers in this regard. The foregoing compounds effectively buffer the pH of the hydraulic fluid to within 8 to 9.5 and are stable at the temperatures experienced by the hydraulic fluids. In choosing a preferred cyclical or ring based tertiary amine with no hydroxyl functionality, it is best to choose ring structures that will not break down or open at temperatures up to 420° F. One preferable ring based tertiary amine with no hydroxyl functionality which is particularly stable at high temperatures is 1,4-dimethyl piperazine. Other suitable ring based tertiary amines with no hydroxy functionality include 2-morpholinoethane sulfonic acid; N-methyl morpholine; N-methyl piperazine; N-methylpyrrolidine; 1.4-piperazine-Bis-ethanesulfonic acid; The concentration of the cyclical or ring based tertiary amine with no hydroxyl functionality in the hydraulic fluid is preferably from 0.1 to 6 weight percent, most preferably from 0.5 to 3 weight percent.

In addition, while the above-described embodiment is preferred for applications such as in hydraulic fluid for subsea control fluids encountered in or with off-shore oil drilling rigs, other embodiments are suitable for many applications. For example, in a substantially corrosion-free environment, a corrosion inhibitor need not be included in the composition of the hydraulic fluid. Similarly, in an environment in which bacterial infestation is not a problem, the biocide may be omitted. For applications at warm or elevated temperatures, a freezing-point depressant is not required.

In a particularly preferred embodiment, the hydraulic fluid is prepared as a ready to use concentrate which does not need diluting to achieve the working performance.

Example I

An aqueous hydraulic fluid was prepared having the following formulation:

| Component | Weight Percent |
|---|---|
| 2-cyclohexene-1-octanoic acid 5-carboxy-4-hexyl (40% w/w) | 4 |
| Monoethylene glycol | 46 |
| C-4 dicarboxylic acid | 3 |
| Potassium hydroxide (50% w/w) | 7 |
| 1,4-dimethyl piperazine | 3 |
| Water | 37 |

This composition was tested as a high pressure hydraulic fluid. It maintained its lubricity after prolonged use (30 days) at 190° C. and was able to tolerate contamination with 10% w/w seawater. The pH of the hydraulic fluid was 9 and was maintained at about 9 through the foregoing prolonged use.

What is claimed is:

1. A method of actuating a subsea control device connected to hydraulic equipment, said method comprising:

a) filling said hydraulic equipment with an aqueous hydraulic fluid composition comprising:
   (i) a lubricant comprising at least one material selected from the group consisting of (a) monovalent metal, ammonium, or amine salt of a dicarboxylic acid and (b) dicarboxylic acids; and
   (ii) a buffer comprising a cyclical tertiary amine with no hydroxyl functionality; and
   (iii) an alkoxylate salt;
   wherein the hydraulic fluid composition is substantially free of an oil selected from the group consisting of mineral oils, synthetic hydrocarbon oils, and mixtures thereof; and
   wherein the concentration of the buffer is such that the pH of the hydraulic fluid is between 8 and 10; and
b) transmitting power to the subsea control device through the flow of the hydraulic fluid through the hydraulic equipment.

2. The method according to claim 1, wherein the aqueous hydraulic fluid composition comprises water in an amount between about 10% and about 65% by weight based on the total weight of the hydraulic fluid composition.

3. The method according to claim 1, wherein the dicarboxylic acid comprises a C21 dicarboxylic acid converted to a salt with a monovalent metal, ammonia, or amine.

4. The method according to claim 1, wherein the method according to claim 1, wherein the salt of the dicarboxylic acid is a potassium salt of the C21 dicarboxylic acid or an amine salt of the C21 dicarboxylic acid.

5. The method according to claim 1, further comprising a second lubricant, said second lubricant said second lubricant selected from the group consisting of alkyl/aryl phosphate esters, alkyl/aryl phosphite esters, phospholipids, carboxylic acids, salts of carboxylic acids, and combinations of the foregoing.

6. The method according to claim 1, wherein the phospholipid comprises a phosphatide selected from the group consisting of phosphatidylcholine, phosphatidylinositol, phosphatidylserine, phosphatidylethanolamine and combinations of one or more of the foregoing.

7. The method according to claim 1, wherein the composition further comprises a biocide.

8. The method according to claim 1, wherein the biocide comprises a boron containing salt, a sulfur-containing biocide or a nitrogen-containing biocide.

9. The method according to claim 1, wherein the composition further comprises of one or more corrosion inhibitors.

10. The method according to claim 1, wherein the corrosion inhibitor is selected from the group consisting of alkyl/aryl phosphate esters, alkyl/aryl phosphite esters, phospholipids, carboxylic acids, salts of carboxylic acids, and combinations of the foregoing.

11. The method according to claim 1, wherein the composition further comprises an anti-freeze additive.

12. The method according to claim 11, wherein the anti-freeze additive is selected from the group consisting of monoethylene glycol, glycerol, propylene glycol, 2-butene-1,4-diol, polyglycol ethers, polyethylene glycols and polypropylene glycols.

13. The method according to claim 1, wherein the tertiary amine comprises a tertiary amine selected from the group consisting of 1,4-Dimethyl piperazine; 2-morpholinoethane sulfonic acid; N-methyl morpholine; N-methyl piperazine; N-methyl pyrrolidine; 1,4-piperazine-Bis-ethane sulfonic acid.

14. The method according to claim 1, wherein the tertiary amine comprises 1,4-dimethyl piperazine.

15. A method of actuating a subsea control device connected to hydraulic equipment, said method comprising:

a) filling said hydraulic equipment with an aqueous hydraulic fluid composition comprising:
   i) one or more lubricants;
   ii) an alkoxylate salt;
   iii) a buffer comprising a cyclical tertiary amine with no hydroxyl functionality;
   iv) at least one dicarboxylic acid or salt of a dicarboxylic acid to the aqueous hydraulic fluid composition, wherein said dicarboxylic acid or salt of said dicarboxylic acid increases the thermal stability of the aqueous hydraulic fluid composition; and wherein the concentration of the buffer is such that the pH of the hydraulic fluid is between 8 and 10, and wherein the hydraulic fluid is substantially free of mineral oils, synthetic hydrocarbon oils and mixtures thereof; and b) transmitting power to the subsea control device through the flow of the hydraulic fluid through the hydraulic equipment.

16. The method according to claim 15, wherein the aqueous hydraulic fluid composition comprises water in an amount between about 10% and about 65% by weight based on the total weight of the hydraulic fluid composition.

17. The method according to claim 15, wherein the dicarboxylic acid salt comprises a C21 dicarboxylic acid.

18. The method according to claim 15, wherein the dicarboxylic acid salt comprises a potassium salt of a C21 dicarboxylic acid or an amine salt of a C21 dicarboxylic acid.

19. The method according to claim 18, wherein the hydraulic fluid composition has high thermal stability and seawater tolerance.

20. The method according to claim 15, wherein the tertiary amine is selected from the group consisting of 2-morpholino ethanesulfonic acid; N-methyl morpholine; N-methyl piperazine; N-methyl pyrrolidine; 1,4 piperazine-Bis-ethanesulfonic acid; 2-morpholine propane sulfonic acid.

21. A method of actuating a subsea control device connected to hydraulic equipment, said method comprising:

a) filling said hydraulic equipment with an aqueous hydraulic fluid composition comprising;
   (i) one or more lubricants; and
   (ii) a buffer comprising a cyclical tertiary amine with no hydroxyl functionality; and
   (iii) at least one salt of a dicarboxylic acid, wherein salt of said dicarboxylic acid increases the thermal stability of the aqueous hydraulic fluid composition;

wherein the concentration of the buffer is such that the pH of the hydraulic fluid is between 8 and 10; and wherein the hydraulic fluid is substantially free of mineral oils, synthetic hydrocarbon oils and mixtures thereof; and b) transmitting power to the subsea control device by the flow of hydraulic fluid through the hydraulic equipment.

22. The method according to claim 21, wherein the tertiary amine comprises 1,4-dimethyl piperazine.

23. The method according to claim 21, wherein the tertiary amine is selected from the group consisting of 2-morpholinoethanesulfonic acid; N-methyl morpholine; N-methyl piperazine; N-methyl pyrrolidine; 1,4 piperazine-Bis-ethanesulfonic acid; 2-morpholine propane sulfonic acid.

* * * * *